US008715117B1

(12) United States Patent
Janish

(10) Patent No.: US 8,715,117 B1
(45) Date of Patent: May 6, 2014

(54) BALL RETRIEVAL SPORTS RACKET

(71) Applicant: Donald F Janish, Rochester, NY (US)

(72) Inventor: Donald F Janish, Rochester, NY (US)

( * ) Notice: Subject to any disclaimer, the term of this patent is extended or adjusted under 35 U.S.C. 154(b) by 0 days.

(21) Appl. No.: 13/894,891

(22) Filed: May 15, 2013

Related U.S. Application Data

(60) Provisional application No. 61/784,331, filed on Mar. 14, 2013.

(51) Int. Cl.
*A63B 47/02* (2006.01)

(52) U.S. Cl.
USPC ..... 473/517; 473/553

(58) Field of Classification Search
USPC ..... 473/517, 553
See application file for complete search history.

(56) References Cited

U.S. PATENT DOCUMENTS

| | | | | |
|---|---|---|---|---|
| 4,834,393 | A * | 5/1989 | Feldi | 473/474 |
| 4,993,712 | A * | 2/1991 | Urwin | 473/517 |
| 5,056,786 | A | 10/1991 | Bellettini et al. | |
| 5,333,854 | A * | 8/1994 | Woollard et al. | 473/517 |
| 5,947,850 | A * | 9/1999 | Gray | 473/517 |
| 7,140,986 | B2 | 11/2006 | Howe | |
| 2003/0216196 | A1 * | 11/2003 | Lamson | 473/517 |
| 2004/0029658 | A1 * | 2/2004 | Howe | 473/553 |
| 2007/0111830 | A1 * | 5/2007 | Wright | 473/553 |
| 2007/0265119 | A1 * | 11/2007 | Dyer | 473/517 |
| 2013/0231204 | A1 * | 9/2013 | Fellini et al. | 473/517 |

FOREIGN PATENT DOCUMENTS

| | | |
|---|---|---|
| DE | 3417595 | 11/1985 |
| DE | 3442742 | 5/1986 |
| DE | 3442743 | 5/1986 |
| GB | 2407516 | 5/2005 |
| KR | 1020120060385 | 6/2012 |

* cited by examiner

*Primary Examiner* — Raleigh W Chiu

(57) ABSTRACT

A ball retrieval sports racket. The ball retrieval sports racket includes a racket with a handle and a head portion. The ball retrieval sports racket further includes a ball retrieval attachment and protective cover for both the head portion of the racket and the handle portion of the racket.

5 Claims, 3 Drawing Sheets

BALL RETRIEVAL SPORTS RACKET

CROSS-REFERENCE TO RELATED APPLICATION

This application claims the benefit of priority of U.S. provisional application No. 61/784,331, filed Mar. 14, 2013, the contents of which are herein incorporated by reference.

BACKGROUND OF THE INVENTION

The present invention relates to racket sports and, more particularly, to ball retrieval in racket sports.

The ball used in pickle ball, as well as other racket sports, does not easily bounce. Seniors and people with injuries have trouble with retrieving the ball during play. Velcro® does not attach to a plastic ball, and ordinary adhesives may get dirty and soon become useless. Magnets are heavy and need to be placed on the ball and the racket.

As can be seen, there is a need for a racket that facilitates easy retrieval of a ball.

SUMMARY OF THE INVENTION

In one aspect of the present invention, a ball retrieval sports racket comprises a racket comprising a head portion and a handle portion; a first ball retrieval attachment attached to the head portion of the racket; a second ball retrieval attachment attached to the handle portion of the racket; a first protective cover removeably attached to the first ball retrieval attachment; and a second protective cover removeably attached to the second ball retrieval attachment.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a ball retrieval sports racket that comprises a racket with a handle portion and a head portion, a ball retrieval attachment and a protective cover for both the handle and head portion of the racket. The ball retrieval attachments are exposed when in use, and the protective covers are attached when the present invention is in transport or storage.

Figure 1:
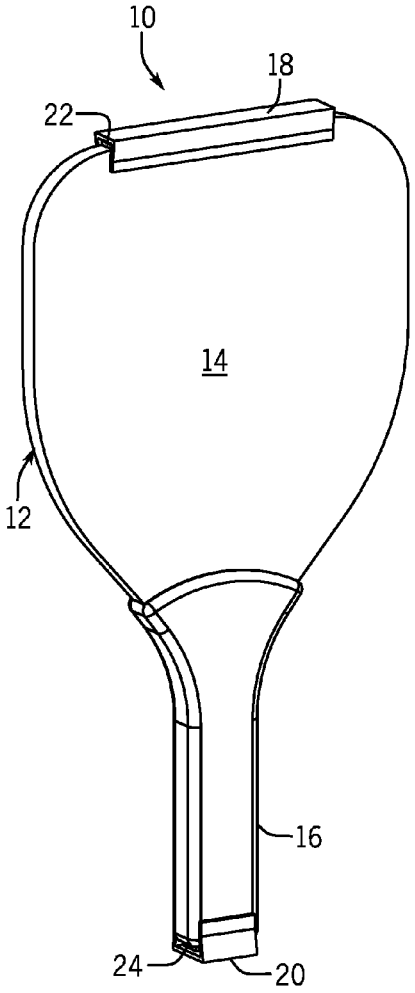
FIG. 1 is a perspective view of a ball retrieval racket according to an exemplary embodiment of the present invention.
Figure 2:
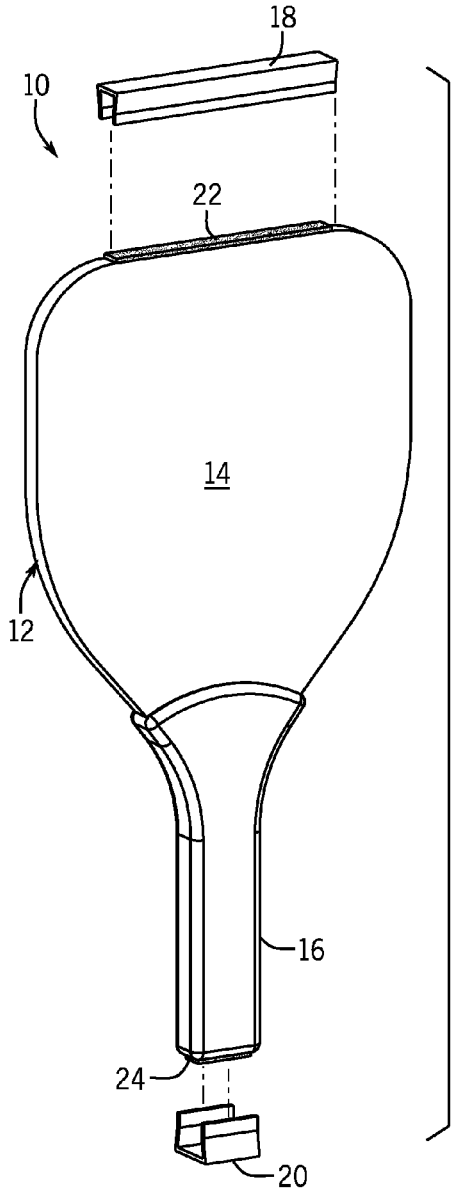
FIG. 2 is an exploded perspective view of the ball retrieval racket of FIG. 1.
Figure 3:
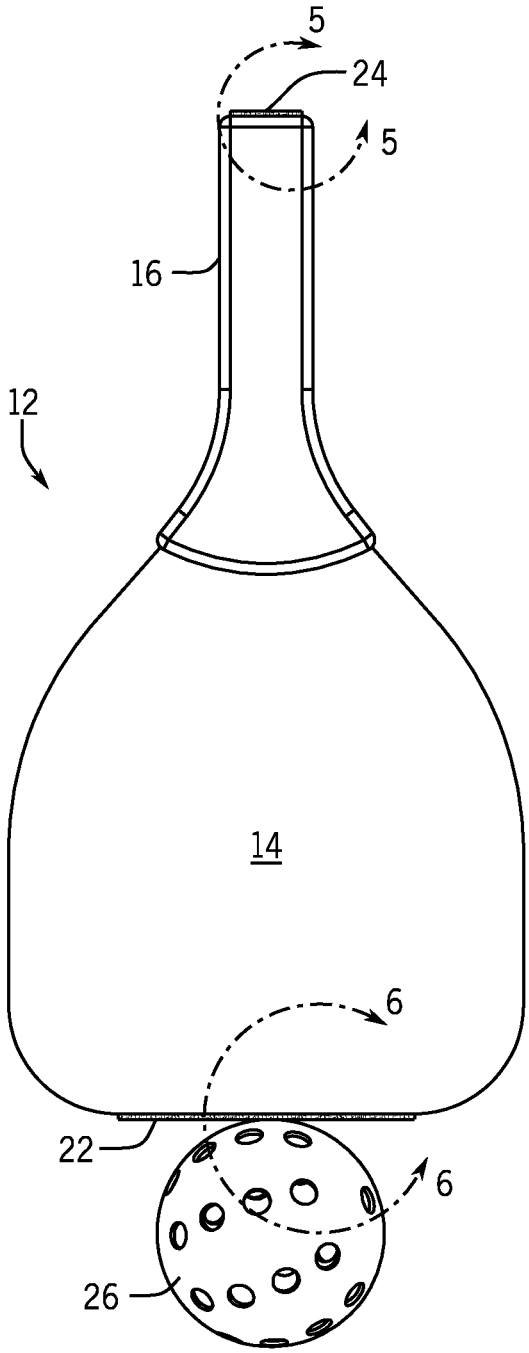
FIG. 3 is a front elevation view of the ball retrieval racket of FIG. 1 attached to ball.
Figure 4:
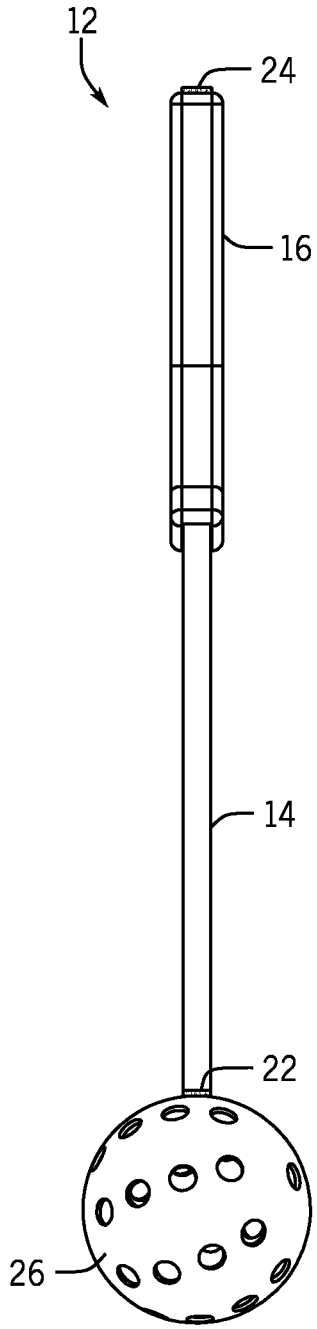
FIG. 4 is a side elevation view of the ball retrieval racket of FIG. 1 attached to ball.
Figure 5:
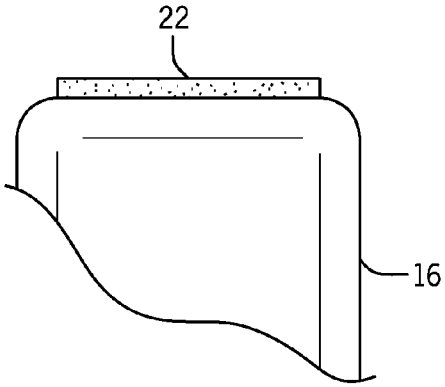
FIG. 5 is a detail front elevation view of the handle of the ball retrieval racket of FIG. 1 with ball retrieval attachment taken along line 5-5 of FIG. 3.
Figure 7:
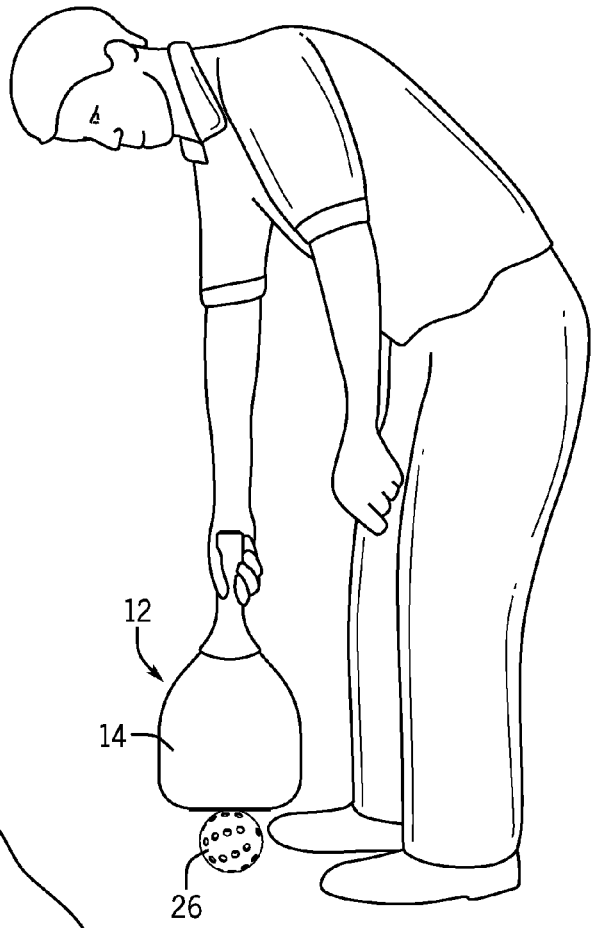
FIG. 7 is a perspective view of the ball retrieval racket of FIG. 1 in use.
Figure 6:
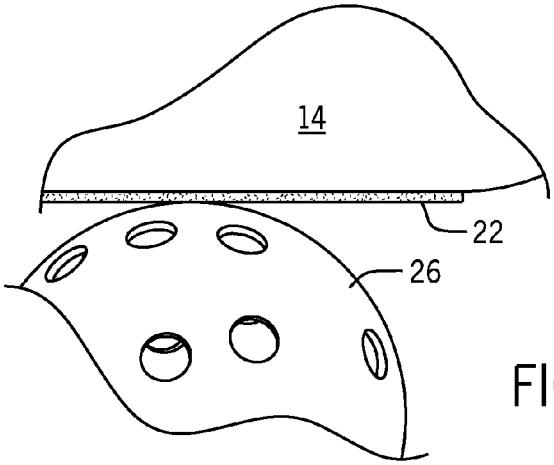
FIG. 6 is a detail elevation view showing a portion of the section taken along line 6-6 of FIG. 3.

Referring now to FIGS. 1 through 7, a ball retrieval sport racket 10 may include a racket 12 having a head 14 and handle 16 portions. In certain embodiments, the present invention may include a first ball retrieval attachment 22, second ball retrieval attachment 24, a first protective cover 18, and a second protective cover 20.

In certain embodiments, the first ball retrieval attachment 22 and the second ball retrieval attachment 24 may include a tacky, sticky substance. The first ball retrieval attachment 22 may be attached to the tip of the head 14 and the second ball retrieval attachment 24 may be attached to the bottom of the handle portion 16 of a racket 12. This allows for a player to bend slightly in order to retrieve the ball 26. The sticky substance may be made from a high bond, closed-cell acrylic foam or the like, that may be easily cleaned with soapy water when the present invention becomes dirty. The ability to clean and reuse the tacky, sticky substance allows for extended use of the ball retrieval sports racket 10. The tacky, sticky substance may be attached using multiple strips. In certain embodiments, a 60×40 pattern may be used for the first ball retrieval attachment 22 and the second ball retrieval attachment 24. When the first ball retrieval attachment 22 and the second ball retrieval attachment 24 are not in use, a first protective cover 18 may cover the first ball retrieval attachment 22 and a second protective cover 20 may cover the second ball retrieval attachment 24 while in transport or storage.

While playing the game of pickle ball, the ball 26 hits the net or goes off the court and out of play. The ball 26 may be easily retrieved by a player by bending over slightly and touching the ball 26 with the first ball retrieval attachment 22 on the head portion 14 of the racket 12, or the second ball retrieval attachment 24 on the handle portion 16 of the racket 12. Holding the racket 12 with one hand, a player may use their other hand to take the ball 26 off the racket 12, and then continue play.

When not playing the game, a player applies the first protective cover 18 over the first ball retrieval attachment 22 and the second protective cover 20 over the second ball retrieval attachment 24. When ready to play or when attempting to pick up a ball, a user may remove at least one of the first protective cover 18 and the second protective cover 20. If the retrieval attachments 22, 24 are not clean, a user may clean the retrieval attachments 22, 24 with soapy water and dry the racket 12 with a cloth, pick up the ball 26 with the racket 12 and start playing.

While the Figures show a pickle ball racket being used, various other sports rackets or clubs may be used as well, such as badminton, paddleball, racquetball, table tennis, golf and the like.

It should be understood, of course, that the foregoing relates to exemplary embodiments of the invention and that modifications may be made without departing from the spirit and scope of the invention as set forth in the following claims.

What is claimed is:

1. A ball retrieval sports racket comprising:

a racket comprising a head portion and a handle portion, wherein the head portion comprises a top and the handle portion comprises a bottom;

at least one of a first ball retrieval attachment attached to the top of the head portion and a second ball retrieval attachment attached to the bottom of the handle portion; and at least one of a first protective cover removably attached to the top of the head portion and a second protective cover removably attached to the bottom of the handle portion, wherein the first protective cover and the second protective cover at least partially cover the at least one of the first ball retrieval attachment and the second ball retrieval attachment.

2. The ball retrieval sports racket of claim 1, wherein the racket is selected from a group consisting of a badminton racket, a paddleball racket, a racquetball racket, a table tennis racket and a golf club.

3. The ball retrieval sports racket of claim 1, wherein the first ball retrieval attachment and the second ball retrieval attachment comprise of multiple strips.

4. The ball retrieval sports racket of claim 1, wherein the first ball retrieval attachment and the second ball retrieval attachment comprise a sticky tack.

5. The ball retrieval sports racket of claim 1, wherein the sticky tack is high bond, closed-cell acrylic foam.

* * * * *